US006109466A

United States Patent [19]

Carrier

[11] Patent Number: 6,109,466

[45] Date of Patent: Aug. 29, 2000

[54] LEAK FREE, INTERFERENCE BEAD CLOSURE ASSEMBLY

[75] Inventor: Frank Leslie Carrier, Milford, Ohio

[73] Assignee: The Procter & Gamble Company, Cincinnati, Ohio

[21] Appl. No.: 08/818,830

[22] Filed: Mar. 15, 1997

[51] Int. Cl.[7] ..... B65D 41/04

[52] U.S. Cl. ..... 215/330

[58] Field of Search ..... 215/329, 330, 215/341, 344, 354, 216, 217, 221; 220/288

[56] References Cited

U.S. PATENT DOCUMENTS

| | | | |
|---|---|---|---|
| 1,986,061 | 1/1935 | Hill | 220/288 X |
| 2,035,972 | 3/1936 | Mangel . | |
| 2,130,749 | 9/1938 | Von Till | 215/329 X |
| 3,122,256 | 2/1964 | Orr | 215/329 |
| 3,295,708 | 1/1967 | Wathen, Jr. . | |
| 3,297,185 | 1/1967 | Plymale . | |
| 3,376,991 | 4/1968 | Deaver . | |
| 3,405,831 | 10/1968 | Hudson . | |
| 3,435,978 | 4/1969 | Wittwer . | |
| 3,445,022 | 5/1969 | Cilluffo . | |
| 3,682,345 | 8/1972 | Baugh . | |
| 3,696,957 | 10/1972 | Van Baarn . | |
| 3,741,421 | 6/1973 | Wittwer . | |
| 3,888,376 | 6/1975 | Cooke . | |
| 3,952,899 | 4/1976 | Cooke . | |
| 3,954,200 | 5/1976 | Willis | 215/206 X |
| 3,963,139 | 6/1976 | Gach . | |
| 3,979,001 | 9/1976 | Bogert . | |
| 4,007,850 | 2/1977 | Beaugrand . | |
| 4,051,974 | 10/1977 | Gentile | 215/329 |
| 4,053,077 | 10/1977 | DeFelice . | |
| 4,084,716 | 4/1978 | Bogert . | |
| 4,084,717 | 4/1978 | King . | |
| 4,084,957 | 4/1978 | Ernst . | |
| 4,139,112 | 2/1979 | Cooke . | |
| 4,193,509 | 3/1980 | Dunn, Jr. et al. . | |
| 4,270,664 | 6/1981 | Buono . | |
| 4,289,248 | 9/1981 | Lynn . | |
| 4,294,370 | 10/1981 | Toeppen . | |
| 4,345,691 | 8/1982 | Burke . | |
| 4,349,116 | 9/1982 | Luenser . | |
| 4,351,442 | 9/1982 | Summers | 215/216 |
| 4,387,822 | 6/1983 | Lynn . | |
| 4,413,743 | 11/1983 | Summers | 215/216 |
| 4,461,394 | 7/1984 | Sendel et al. . | |
| 4,664,273 | 5/1987 | Simon | 215/217 X |
| 4,697,715 | 10/1987 | Beruvides . | |
| 4,770,308 | 9/1988 | Lynn . | |
| 5,169,033 | 12/1992 | Shay . | |
| 5,213,225 | 5/1993 | King et al. . | |
| 5,676,270 | 10/1997 | Roberts | 215/330 |
| 5,702,014 | 12/1997 | Nielsen | 215/217 |
| 5,713,479 | 2/1998 | Brady . | |
| 5,884,790 | 3/1999 | Seidita | 215/252 |

FOREIGN PATENT DOCUMENTS

| | | | |
|---|---|---|---|
| 2565939 | 12/1985 | France | 215/329 |
| 2 100 236 | 12/1982 | United Kingdom . | |
| 2 159 801 | 12/1985 | United Kingdom . | |

*Primary Examiner*—Allan N. Shoap
*Assistant Examiner*—Joe Merek
*Attorney, Agent, or Firm*—James C. Vago; Elizabeth M. Koch

[57] ABSTRACT

An interference threaded closure assembly includes a container and a cap. The container has a neck portion extending therefrom, the neck portion forming an opening and having on an outer surface screw threads and at least one interference bead on the screw threads. The cap has on an inner surface screw threads and a seal for releasably engaging the opening of the neck portion to form a leak free seal. The interference bead of the screw threads engages the screw threads of the cap to create an interference fit when the screw threads are threadably engaged, thereby maintaining the leak free seal of the seal within the opening.

5 Claims, 4 Drawing Sheets

LEAK FREE, INTERFERENCE BEAD CLOSURE ASSEMBLY

FIELD OF THE INVENTION

This invention relates to the field of threaded closure assemblies, and more particularly, to an interference threaded closure assembly which prevents wobbling and back-off of the closure.

BACKGROUND OF THE INVENTION

Conventional liquid filled plastic bottles which utilize a threaded plastic cap have typically had problems with leaking due to the cap wobbling and "backing-off" (i.e., loosening) during shipment and handling. This problem is particularly troublesome for dispensing closures such as trigger sprayers that have high profile heads which can apply leverage to back off the cap if bumped.

In an effort to alleviate the problem, excessive torque can be applied. However, this could result in the plastic threads being over stressed, thereby damaging the threads and compromising the quality of the seal. Furthermore, over torquing the closure is not possible where the closure must be rotated to a particular position or orientation.

Conventional bottle filling production lines typically torque closures to a specific load or position. This requires complicated clutch systems that sustain wear and need constant adjustment, which has a negative effect on process reliability.

Therefore, what is needed is a closure assembly having interference threads which provide a leak free seal regardless of rocking or wobbling of the closure assembly. Furthermore, what is needed is a seal created by rotating the closure to particular position rather than to a specific torque, thereby eliminating wear items and the need for adjustment resulting in improved process reliability.

SUMMARY OF THE INVENTION

An interference threaded closure assembly, comprises a container having a neck portion extending therefrom, the neck portion forming an opening and having on an outer surface at least one first member and at least one interference bead on the at least one first member; and a cap having on an inner surface at least one second member and a seal for releasably engaging the opening of the neck portion to form a leak free seal, wherein the at least one interference bead of the at least one first member engages the at least one second member to create an interference fit when the at least one first member and the at least one second member are engaged, thereby maintaining the leak free seal of the seal within the opening.

DETAILED DESCRIPTION OF THE INVENTION

Figure 1:
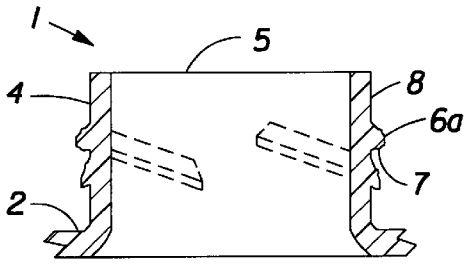
FIG. 1 is a cross sectional view of the preferred container's neck portion having interference threads according to the preferred embodiment of the present invention.

Referring to FIGS. 1–4, a preferred interference threaded closure assembly 1 includes a container 2 and a cap 3. The container 2 includes a neck portion 4, which forms an opening 5 and has screw threads 6*a* (FIG. 1) with at least one interference bead 7, all located on an outer surface 8 of the neck portion 4. The interference bead 7 is preferably substantially round but may comprise a variety of configurations without deviating from the intent of the invention.

The cap 3 preferably includes a matching set of screw threads 9*a* (FIG. 2) or grooves 9*b* (FIG. 4) on an inner surface 10 of the cap 3 which threadably engage the grooves 6*b* and screw threads 6*a*, respectively. The screw threads 9*a* or grooves 9*b* preferably have at least one interference bead 11 for engaging the grooves 6*b* or screw threads 6*a*, respectively. The cap 3 also includes a seal 12 for releasably engaging the opening 5 of the neck portion 4 to form a leak free seal, the seal 12 also being located on the inner surface 10 of the cap 3. Preferably, the seal 12 comprises a plug seal but may comprise a conventional gasket without deviating from the intent of the invention.

Figure 2:
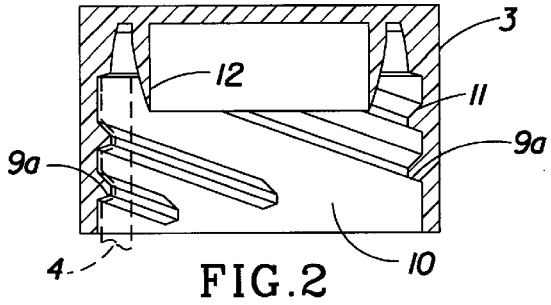
FIG. 2 is a cross sectional view of the preferred cap having interference threads according to the preferred embodiment of the present invention.
Figure 3:
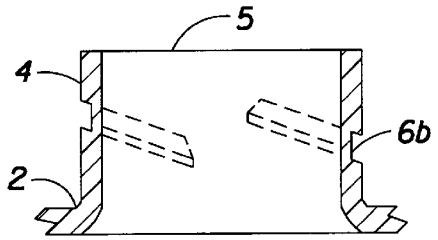
FIG. 3 is a cross sectional view of an alternate container's neck portion having interference threads according to the preferred embodiment of the present invention.
Figure 4:
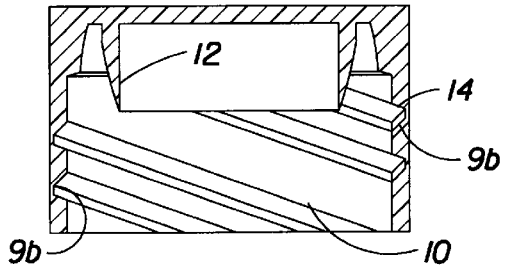
FIG. 4 is a cross sectional view of an alternate cap having interference threads according to the preferred embodiment of the present invention.

Referring to the preferred embodiment of FIGS. 1 and 2, during engagement, the interference beads 7, 11 create an interference fit when the screw threads 6*a* of the neck portion 4 threadably engage the screw threads 9*a* of the cap 3. The interference beads 7, 11 resist the side to side rocking or wobbling that can occur as a result of force applied to the closure and bottle. By substantially eliminating any side to side rocking or wobbling, the leak free seal is maintained between the plug seal or gasket 12 and the opening 5.

As a result of the preferred interference threaded closure assembly 1 as seen in FIGS. 1 and 2, containers with relatively large heads, such as trigger sprayers, can be safely handled and shipped without the risk that the head will supply sufficient leverage to rock or deflect the closure enough to break the seal. Furthermore, the application torque required is negligibly affected by the interference beads 7, 11 since the interference fit is on the raised interference beads 7, 11 only and not the full width of the threads, In addition, the interference bead compression and interference will also resist back-off. In addition, the preferred anti-backoff closure assembly 1 is variable in that the cap 3 may be tightened to a variety of positions while maintaining the leak free seal between the plug seal or gasket 12 and the opening 5 due to stability created by the interference beads 7, 11 which occurs along the screw threads 6*a*, 9*a* during rotation.

Alternatively, the neck portion 4 may utilize grooves 6*b* (FIG. 3) in place of the screw threads 6*a* (FIG. 1), also with at least one interference bead 13. Similarly, the cap 3 may include grooves 9*b* (FIG. 4) in place of screw threads 9*a* (FIG. 3) which threadably engage the screw threads 6*a* of the neck portion 4. The grooves 9*b* also have at least one interference bead 14 for engaging the screw threads 6*a* of the neck portion.

Referring to FIGS. 5*a*–5*f*, the interference fit of the interference beads 7, 11 may be used individually or in combination without deviating from the intent of the invention. For example, in FIG. 5*a*, only the screw thread 6*a* (FIG. 1) of the neck portion 4 has interference beads 7, which engage the screw thread 9*a* (FIG. 2) of the cap 3 to create an interference fit between the screw threads 6*a*, 9*a*.

Figure 5A:
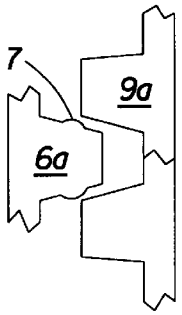
FIGS. 5*a–f* are cross sectional views of the screw thread's interference bead's of the cap and neck portion during engagement according to the preferred and alternate embodiments of the present invention.
Figure 5B:
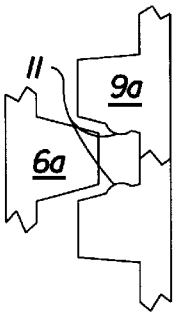

In FIG. 5*b*, the screw thread 6*a* (FIG. 1) of the neck portion 4 engages the interference beads 11 of the screw thread 9*a* (FIG. 2) of the cap 3 to create an interference fit between the screw threads 6*a*, 9*a*.

Figure 5C:
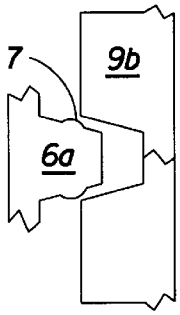

In FIG. 5*c*, only the screw thread 6*a* (FIG. 1) of the neck portion 4 has interference beads 7, which engage the groove 9*b* (FIG. 4) of the cap 3 to create an interference fit between the screw threads 6*a*, 9*a*.

Figure 5D:
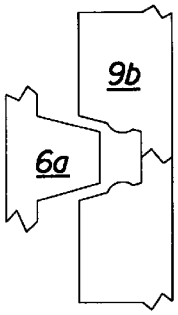

In FIG. 5*d*, the screw thread 6*a* (FIG. 1) of the neck portion 4 engages the interference beads 7 of the groove 9*b* (FIG. 4) of the cap 3 to create an interference fit between the screw threads 6*a* and the groove 9*b*.

Figure 5E:
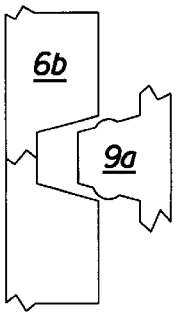

In FIG. 5*e*, the groove 6*b* (FIG. 3) of the neck portion 4 engages the interference beads 11 of the screw thread 9*a* (FIG. 2) of the cap 3 to create an interference fit between the groove 6*b* and screw thread 9*a*.

Figure 5F:
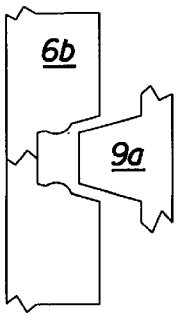

In FIG. 5*f*, the interference beads 13 of the groove 6*b* (FIG. 3) of the neck portion 4 engage the screw thread 9*a* (FIG. 2) of the cap 3 to create an interference fit between the groove 6*b* and screw thread 9*a*.

Figure 6:
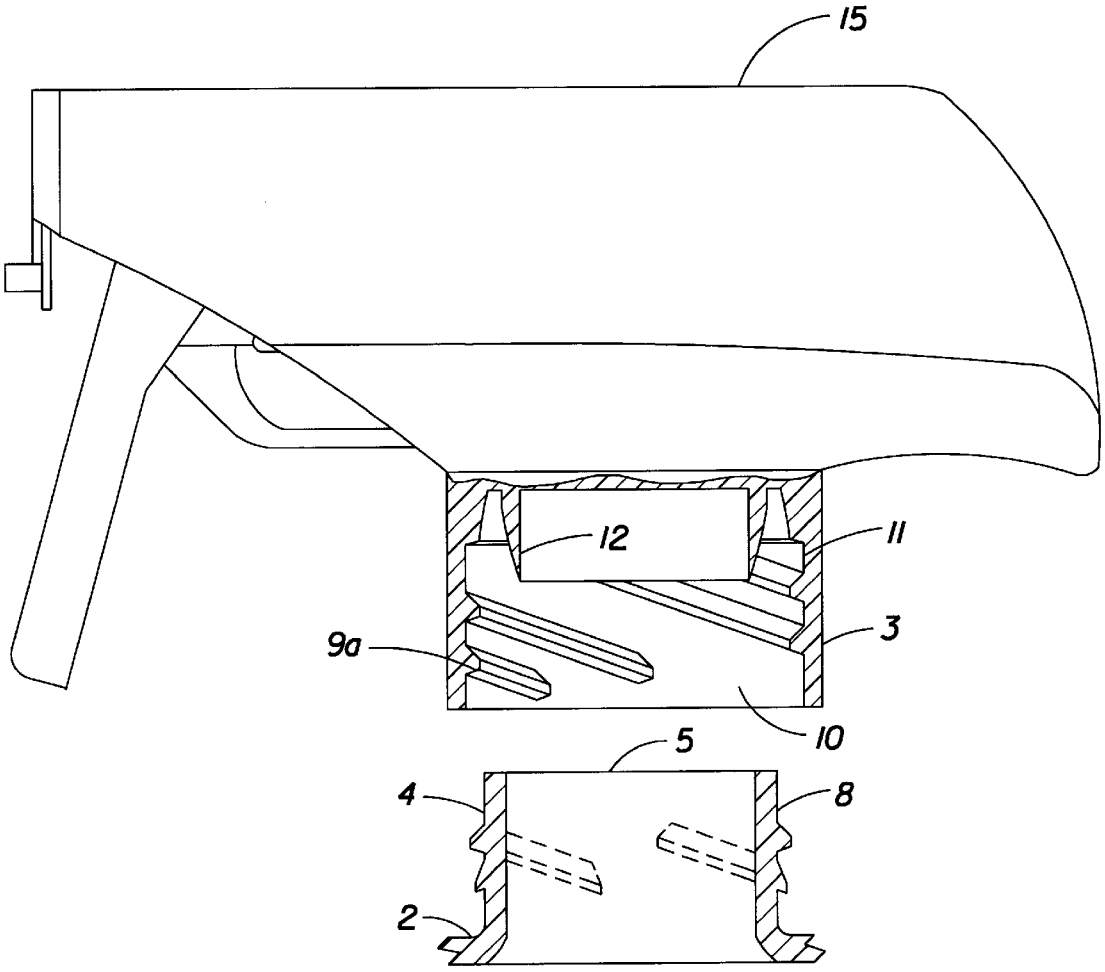
FIG. 6 is a side view of a trigger sprayer cap having interference threads for engagement with the neck portion of FIGS. 1 and 3 according to the preferred embodiment of the present invention.

Referring to FIG. 6, the interference beads 7, 11 (FIGS. 1 and 2) and 13, 14 (FIGS. 3 and 4) enable the cap 3 and neck portion 4 to hold their position based on where the cap 3 is rotated and not limited to where the interference beads 7, 11 and 13, 14 are molded as in the prior art, particularly when a trigger sprayer 15 is mounted to the cap 3 (FIG. 6). Thus, the interference beads 7, 11 (FIGS. 1 and 2) and 13, 14 (FIGS. 3 and 4) substantially eliminate wobbling, rocking, and "back-off" of the cap 3 which results in a substantially leak-free seal between the container 2 and the cap 3.

Figure 7:
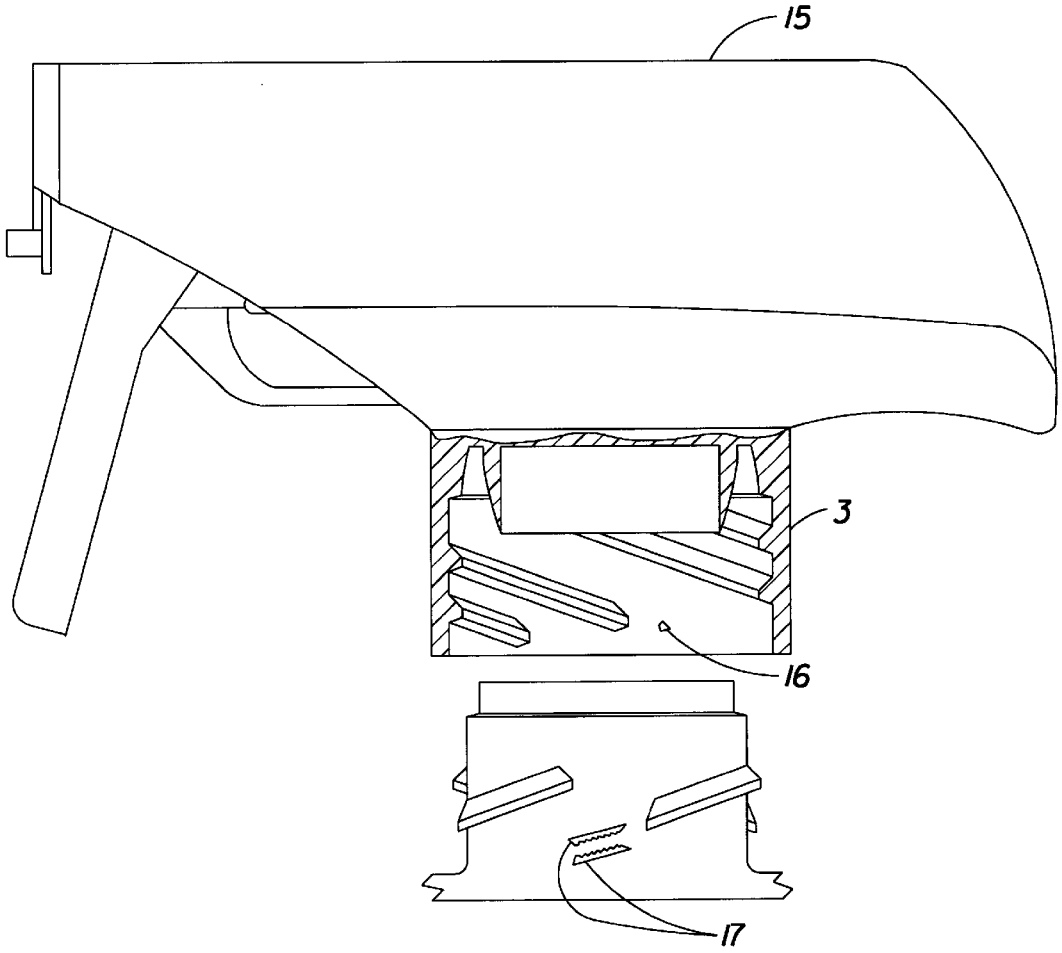
FIG. 7 is a side view of an alternate trigger sprayer cap having a wedge shaped locking member for engagement with the neck portion according to the present invention.

Referring to FIG. 7, an alternate embodiment includes the cap 3 having a trigger sprayer 15 and a wedge shaped locking member 16 for engagement with alligator teeth 17 positioned on the outer surface 8 of the neck portion 4, in addition to the interference beads 7, 11 and 13, 14. The wedge shaped locking member 16 is preferably positioned on the inner surface 10 of the cap 3. The locking member 16 and the alligator teeth 17 engage when the cap 3 and neck portion 4 are substantially engaged, thus creating a leak-free seal between the cap 3 and neck portion 4. The locking member 16 may be positioned on the outer surface 8 of the neck portion 4 and the alligator teeth 17 may be positioned on the inner surface 10 of the cap 3 without deviating from the intent of the invention.

Figure 8:
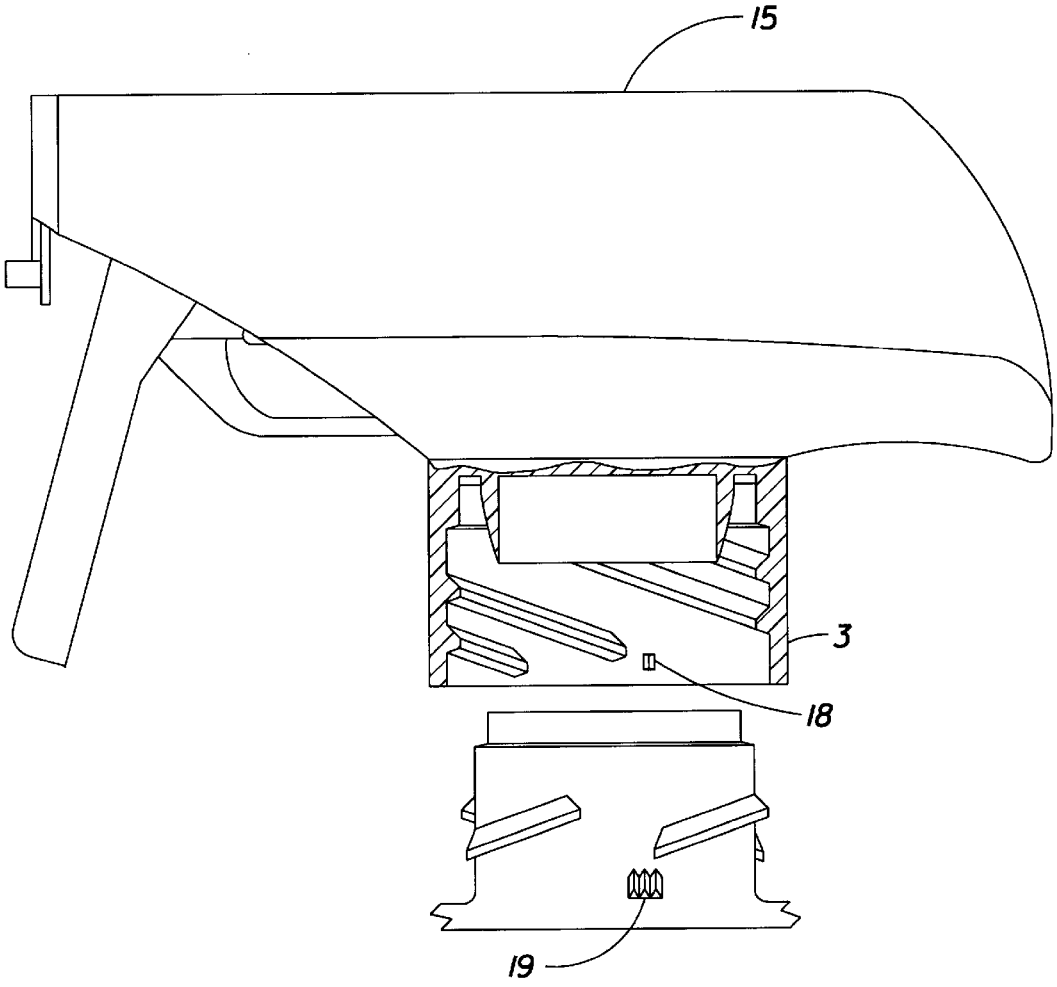
FIG. 8 is a side view of an alternate trigger sprayer cap having vertical ribs for engagement with the neck portion according to the present invention.

Referring to FIG. 8, an alternate embodiment includes the cap 3 also having a trigger sprayer 15 and a locking member 18 for engagement with vertical ribs 19 positioned on the outer surface 8 of the neck portion 4, in addition to the interference beads 7, 11 and 13, 14. The locking member 18 is preferably positioned on the outer surface 8 of the neck portion 4. The locking member 18 and the vertical ribs 19 engage when the cap 3 and neck portion 4 are substantially engaged, thus creating a leak-free seal between the cap 3 and neck portion 4. The locking member 18 may be positioned on the outer surface 8 of the neck portion 4 and the vertical ribs 19 may be positioned on the inner surface 10 of the cap 3 without deviating from the intent of the invention.

While the embodiment of the invention shown and described is fully capable of achieving the results desired, it is to be understood that this embodiment has been shown and described for purposes of illustration only and not for purposes of limitation. Other variations in the form and details that occur to those skilled in the art and which are within the spirit and scope of the invention are not specifically addressed. Therefore, the invention is limited only by the appended claims.

What is claimed is:

1. A leak free, interference bead closure assembly, comprising:

a container having a neck portion extending therefrom, said neck portion forming an opening and having a first screw thread on an outer surface;

a cap having a second screw thread on an inner surface and a seal for releasably engaging said opening of said neck portion to form a leak free seal, wherein said second screw thread engages said first screw thread; and a first interference bead disposed on a first side wall of at least one of said first and second threads and a second interference bead disposed on a second side wall opposite said first side wall on the same thread as said first interference bead, said first and second interference beads being spaced apart, wherein said second side wall forms part of said at least one of said first thread and said second thread having said first interference bead, wherein said first and second interference beads each create an interference fit between said first thread and said second thread when said container and said cap are threadedly engaged, thereby maintaining a leak free seal and eliminating side to side wobbling of the closure assembly.

2. The interference bead closure assembly of claim 1, wherein at least one of said first and second interference beads are substantially sharp edged.

3. The interference bead closure assembly of claim 1, further comprising at least one of a trigger sprayer pump and an orifice dispensing closure mounted on said cap.

4. The interference bead closure assembly of claim 1, wherein said seal comprises a plug seal.

5. The interference bead closure assembly of claim 1, wherein said second interference bead is disposed opposite said first interference bead.

* * * * *